US007387694B2

(12) United States Patent
Siebenlist et al.

(10) Patent No.: US 7,387,694 B2
(45) Date of Patent: Jun. 17, 2008

(54) METHOD OF MAKING A HARDENED STEEL PART, ESPECIALLY A ROLL LOAD-BEARING STEEL PART

(75) Inventors: Norbert Siebenlist, Poppenhausen (DE); Walter Krauss, Werneck-Schraudenbach (DE)

(73) Assignee: Rexroth Star GmbH, Schweinfurt (DE)

( * ) Notice: Subject to any disclaimer, the term of this patent is extended or adjusted under 35 U.S.C. 154(b) by 45 days.

(21) Appl. No.: 10/680,477

(22) Filed: Oct. 7, 2003

(65) Prior Publication Data

US 2004/0108027 A1 Jun. 10, 2004

(30) Foreign Application Priority Data

Oct. 10, 2002 (DE) ..... 102 47 372

(51) Int. Cl.
*C21D 8/00* (2006.01)
*C22C 38/00* (2006.01)

(52) U.S. Cl. ..... 148/579; 148/320

(58) Field of Classification Search ..... 148/335, 148/320, 328, 651–654, 587, 579; 384/912
See application file for complete search history.

(56) References Cited

U.S. PATENT DOCUMENTS

| | | | | |
|---|---|---|---|---|
| 3,532,560 A * | 10/1970 | Tomioka et al. | ..... | 148/599 |
| 3,944,442 A * | 3/1976 | Donachie | ..... | 148/506 |
| 4,973,368 A | 11/1990 | Lund | | |
| 5,496,425 A | 3/1996 | Gallagher, Jr. | | |
| 5,672,014 A * | 9/1997 | Okita et al. | ..... | 384/492 |
| 6,306,230 B1 | 10/2001 | Hengerer | | |
| 6,334,370 B1 | 1/2002 | Sonoda | | |

FOREIGN PATENT DOCUMENTS

| | | | | |
|---|---|---|---|---|
| DE | 198 21 797 C1 | | 7/1999 | |
| DE | 100 14 856 A1 | | 10/2001 | |
| EP | 0 943 694 A1 | | 9/1999 | |
| GB | 577 133 | | 5/1946 | |
| JP | 358031031 | * | 2/1983 | ..... 148/593 |
| JP | 40257637 | * | 2/1990 | ..... 148/580 |

OTHER PUBLICATIONS

Metals Handbook Ninth Edition, vol. 14 "Forming and Forging" ASM, 1988, pp. 6,7,10 and 158.*

* cited by examiner

*Primary Examiner*—Roy King
*Assistant Examiner*—Jessee Roe
(74) *Attorney, Agent, or Firm*—Michael J. Striker

(57) ABSTRACT

The method of making a hardened steel part or component includes making a semi-finished article of air-hardened steel; cold-forming the semi-finished article into a finished-shape part or component with a desired or predetermined finished shape and then hardening the finished-shape part or component with the finished shape by a heat treating process. The air-hardened steel particularly preferably contains about 0.67% by weight carbon, about 1.50 % by weight silicon, about 1.50% by weight manganese, about 1.00% by weight chromium, about 0.10% by weight nickel, about 0.25% by weight molybdenum, and a balance or remaining portion of iron with standard impurities.

7 Claims, No Drawings

METHOD OF MAKING A HARDENED STEEL PART, ESPECIALLY A ROLL LOAD-BEARING STEEL PART

CROSS-REFERENCE

The invention described and claimed hereinbelow is also described in German Patent Application DE 102 47 372.2, filed Oct. 10, 2002. This German Patent Application, whose subject matter is incorporated here by reference, provides the basis for a claim of priority of invention under 35 U.S.C. 119(a)-(d).

BACKGROUND OF THE INVENTION

1. Field of the Invention

The present invention relates to a method of making a hardened, especially a roll load-bearing, prefabricated steel part and, more particularly, to a method of making a nut for a roll barrel screw drive.

2. Description of the Related Art

Conventionally a semi-finished product from roller bearing steel, for example 100 Cr 6, is pre-shaped in a softened condition during this sort of manufacturing process. Subsequently either the entire structural component or at least its functional surfaces are heat-treated, in order to obtain a surface hardness of greater than or equal to 58 HRC and the hardness depth required for operating under load. Usually a martensitic structure is produced during the heat-treatment, which suffices for the above-mentioned conditions. Dimension and shape changes of the structural component (hardened lagging) result from thermal stresses produced by the heat treatment due to temperature gradients and phase change-related transformation stresses, based on the complex non-single-cause interactions between the internal stresses of the structural components. These dimension and shape changes are for the most part largely stochastic in nature and can only be insufficiently taken into account in the optimization of the starting materials, the softening processing and the heat treatment. The highly accurate geometric shape required for operation of the roll load-bearing structural part, for example the nut of a roll barrel screw drive, can be obtained only by the following procedure. First the part with suitable dimensions is pre-shaped in a softened state. Then in the hardened state it is after-worked with defined or undefined milling or cutting tools in connection with the heat treatment to form the required geometric shape.

Already alternative manufacturing methods have been proposed, which are designed to eliminate the working step in the hardened state. U.S. Pat. No. 6,334,370 B1 should be mentioned for this reason. This starting point however leads to production of structural parts either with insufficient accuracy or to roll load-bearing parts which do not fulfill the general specifications after heat treatment.

A method of making hardened steel parts is disclosed in DE 198 21 797 C1, in which a material characterized as air-hardened steel is used. In this reference, and also in the case of the present invention, the term "air-hardened steel" means a class of materials, whose temperature-time transformation behavior after an austenitization provides cooling speeds, which are sufficient to initiate a martensitic phase transformation, assuming air heat transfer coefficients. In the known method the steel part is heated to over 1100° C. Thermal transformation of the structural part is performed at this temperature and the structural part is subsequently cooled in air and simultaneously subjected to a thermo-mechanical treatment. This method has the disadvantage that the tools used during the thermal transformation and the thermo-mechanical treatment must withstand temperatures of up to 1100° C. Thus the use of special tools is required. Furthermore the working of the component or part must be performed under temperature-controlled conditions, i.e. under spatially and/or engineering limited conditions.

SUMMARY OF THE INVENTION

It is an object of the present invention to provide a method of manufacturing hardened steel parts or components, especially roll load-bearing parts, especially a nut of a roll barrel screw drive, which is performed without use of special tools and without stress-raising hard-working of the part or component.

The method of making a hardened steel part or component according to the invention comprises the steps of:

a) making a semi-finished article of air-hardened steel;

b) cold-forming the semi-finished article into a finished-shape part or component having a predetermined or desired shape; and c) then hardening the finished-shape part or component by a heat treating process.

The material called "air-hardened" steel of the present invention is characterized by high uniformity, very good cold plastic processing properties, good machining properties in the softened state and outstanding machining properties in the hardened state. The minimum carbon content is selected so that the minimum hardness required for use as a roll load-bearing part or component can be reliably provided. As already mentioned the special temperature-time behavior of these steel materials permits a sufficiently slow cooling for formation of martensitic structure, so that no forced cooling by water, polymer solutions, oils, salt melts or by high pressure gas quenching or the like needs to be performed.

The material exhibits only small dimension and shape changes during the heat treatment for production of martensitic and/or bainitic structure as a result of the minimization of the internal cooling stress, which has thereby been made possible. This material has a cooling behavior of a high alloy and extreme high alloy materials, but without the high raw material costs associated with a high alloy element content. In contrast to high alloy materials the costly secondary metallic processes, such as ESR and VAR, required because of their special mixed phase thermodynamics, can be dispensed with in the case of this material. Especially using air-hardened steel the martensitic structure changes can be induced by slow cooling, especially a cooling with resting or inert air, without the presence of cost-intensive alloy elements in appropriate high concentrations.

It has been totally shown that air-hardened steels have the required dimension stability for hardened parts, especially for roll load-bearing parts, when they are put in their final form or shape already in the cold state and the heat treatment actually only serves for hardening of the finished-shape part. In the method according to the invention thus it is not only possible to avoid the stress-raising hard-working process after heat treatment, but also the form-shaping of the part is performed in its cold state so that the method can be performed with conventional tools. Both these features lead to considerable economies and simplifications during the manufacture of these steel parts or components.

DETAILED DESCRIPTION OF THE PREFERRED EMBODIMENTS

Independently of the exact manner of heat treatment suitable air-hardened steel has the following composition:

about 0.31% by weight to about 0.85% by weight carbon (C), about 0.95% by weight to about 2.10% by weight silicon (Si), about 1.15% by weight to about 1.85% by weight manganese (Mn), about 0.00% by weight to about 1.65% by weight chromium (Cr), about 0.05% by weight to about 0.20% by weight nickel (Ni), about 0.10% by weight to about 0.70% by weight molybdenum (Mo), with a balance or remaining portion of iron and the usual or standard impurities. The usual impurities can be, for example, oxygen in a concentration of up to 10 ppm and titanium (Ti) in a concentration of up to 30 ppm.

In a particularly preferred embodiment the steel has the following composition:

about 0.67% by weight carbon (C), about 1.50% by weight silicon (Si), about 1.50% by weight manganese (Mn), about 1.00% by weight chromium (Cr), about 0.10% by weight nickel (Ni), about 0.25% by weight molybdenum (Mo), with a balance or remaining portion of iron and the usual impurities.

The shaping of the component can take place by e.g. hammering. Alternatively it is also possible to cold-form the semi-finished article by tapping and pressing. Both these operations are explained in more detail in the following example of the manufacture of a nut for a roll barrel screw drive.

A cylindrical semi-finished article is pushed on a profiled mandrel, which has the inner shape of the roll barrel face, by hammering or rotary swaging. The material of the semi-finished article is shaped on the profiled mandrel by a number of rams, which rotate and execute striking impacts by centrifugal force. The work piece executes an axial motion so that it advances. After cold-forming the profiled mandrel is rotated away from the part and a milling operation is performed on its outer surface.

The part or component is made by milling up to the roll barrel face by tapping and pressing. First the face is formed in the part by tapping with a small offset. Subsequently it is brought to size by a pressing process and its surface is smoothed.

The thorough hardening over the entire volume of the part by means of a conventional oven technique is an example of a heat-treating process that is suitable in the method according to the invention. This hardening method can be performed with or without a special atmosphere, by means of vacuum hardening or by magnetic hardening, inductive hardening or flame hardening or nitration or carbonitration. As associated data, which describe the conversion process of the steel and thus the phase space of the thermo-mechanical processing possibilities, the following should be mentioned:

The austenitizing occurs at a temperature $T_{Austenite}$ of more than 900° C., preferably from about 920° C. and about 950° C.

The perlite formation occurs at cooling speeds of less than about 0.1 K/sec in a temperature range between a starting temperature $T_{Perlite,star}$ of about 680° C. and a final temperature $T_{perlite,final}$ of about 650° C.

The martensite formation starts at a temperature $T_{Martensite,start}$ of about 200° C.

While in the case of conventional hardened roller bearing steel, for example SAE 52100, the structural part must be cooled in seconds to a temperature $T_{Martensite,start}$ of about 290° C., in the case of the present invention hours are available. However depending on the alloy compositions in the case of an industrial heat treatment and/or thermo-mechanical process refining effects must be considered.

After hardening, the structural component or part can then be subjected to a surface improving or refining treatment, which amounts to no geometry changing or producing milling process, but only to a process, such as polishing, grinding, lapping or the like, which decisively affects the surface characteristics. Particularly the surface characteristics include the surface roughness. The surface roughness is expressed with a number of parameters. These parameters include the arithmetic mean roughness, Ra; the roughness depth, Rz (arithmetic means of the individual roughness depths Rzi of successive individual sections), the maximum roughness depth, Rmax within a predetermined measured section; the ratio Rmr of the length of the material filled section portions to the length of the entire measured section, or the peak number HSC, i.e. the number of section peaks, which exceed a predetermined section level (see DIN 4762 and/or ISO 4287/1).

The disclosure in German Patent Application 102 47 372.2 of Oct. 10, 2002 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a method of making hardened steel parts, especially rolled parts., it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A method of making an air-hardened steel roll bearing part or component, wherein said method comprises the steps of making air-hardened steel with a composition comprising:

from about 0.31% to about 0.85% by weight carbon, from about 0.95% to about 2.10% by weight silicon, from about 1.15% to about 1.85% by weight manganese, from about 0.00% to about 1.65% by weight chromium, from about 0.05% to about 0.20% by weight nickel, from about 0.10% to about 0.70% molybdenum, and iron;

making from the air-hardened steel a semi-finished article, wherein a minimum carbon content of the semi-finished article is selected so that a minimum hardness required for use as the roll bearing part or component is provided, wherein a temperature-time behavior of the air-hardened steel permits a cooling that is sufficiently slow for formation of a martensitic structure, such that no forced cooling process must be performed;

cold-forming the semi-finished article into a finished shaped roll bearing part or component with a predetermined finished shape;

then hardening the finished-shape roll bearing part or component by a heat treating process, wherein no forced cooling is employed and a martensitic structure is formed;

but does not include hard-working of the roll bearing part or component after said heat treating process and no further form-shaping occurs after the cold-forming.

2. The method as defined in claim 1, wherein the composition of the air-hardened steel includes standard impurities.

3. The method as defined in claim 1, wherein said cold-forming of the semi-finished article comprises hammering the semi-finished article.

4. The method as defined in claim 1, wherein said cold-forming of the semi-finished article comprises tapping and pressing the semi-finished article.

5. The method as defined in claim 1, further comprising performing a surface improving treatment after said hardening and wherein said surface improving treatment does not change said predetermined finished shape of the roll bearing part or component.

6. A method of making a roll bearing part or component, wherein said method comprises the steps of:

making a semi-finished article of air-hardened steel, wherein a minimum carbon content of the semi-finished article is selected so that a minimum hardness required for the roll bearing part or component is provided, wherein a temperature-time behavior of the air-hardened steel permits a cooling that is sufficiently slow for formation of a martensitic structure, such that no forced cooling process must be performed;

cold-forming the semi-finished article into a finished-shaped roll bearing part or component with a predetermined finished shape;

then hardening the finished-shape roll bearing part or component by a heat treating process, wherein no forced cooling is employed and a martensitic structure is formed;

selecting a composition of the air-hardened steel comprising:

about 0.67% by weight carbon, about 1.50% by weight silicon, about 1.50% by weight manganese, about 1.00% by weight chromium, about 0.10% by weight nickel, about 0.25% by weight molybdenum, and iron;

but does not include hard-working of the roll bearing part or component after said heat treating process and no further form-shaping occurs after the cold-forming.

7. The method as defined in claim 6, wherein the composition of the air-hardened steel includes standard impurities.

* * * * *